US006629433B2

(12) United States Patent
Corduan et al.

(10) Patent No.: US 6,629,433 B2
(45) Date of Patent: Oct. 7, 2003

(54) PROCESS AND APPARATUS FOR HEAT EXCHANGE

(76) Inventors: Horst Corduan, Allinger Str. 21, Puchheim (DE), 82178; Dietrich Rottmann, Oskar-Maria-Graf-Ring 33, Munich (DE), 81737; Karl Leibl, Burgkmairstr. 50, Munich (DE), 80686

( * ) Notice: Subject to any disclaimer, the term of this patent is extended or adjusted under 35 U.S.C. 154(b) by 127 days.

(21) Appl. No.: 09/844,254

(22) Filed: Apr. 30, 2001

(65) Prior Publication Data

US 2002/0124596 A1 Sep. 12, 2002

(30) Foreign Application Priority Data

Apr. 28, 2000 (DE) ..... 100 21 081

(51) Int. Cl.[7] ..... F25J 3/00
(52) U.S. Cl. ..... 62/617; 62/903
(58) Field of Search ..... 62/617, 640, 903

(56) References Cited

U.S. PATENT DOCUMENTS 5,035,284 A 7/1991 Oya et al.
5,333,683 A 8/1994 Arriulou et al.

FOREIGN PATENT DOCUMENTS

| | | |
|---|---|---|
| DE | 4204172 | 8/1993 |
| EP | 0971189 | 1/2000 |
| FR | 2778971 | 11/1999 |

*Primary Examiner*—Alan J. Flanigan
(74) *Attorney, Agent, or Firm*—Millian, White, Zelano & Branigan, P.C.

(57) ABSTRACT

For the indirect heat-exchange of a plurality of gas streams (14, 15, 16) with a heat-cold carrier (2, 7) in heat-exchange blocks (23*a, b, c, d, e*) in which the gas streams (14, 15, 16) are passed through a multiplicity of heat-exchange passages, only one of the gas streams (14, 15, 16) is passed in this case through at least one heat-exchange block (23*a, b, c, d, e*). The heat-exchange passages of the heat-exchange block (23*a, b, c, d, e*), through which this gas stream (14, 15, 16) flows end at two end surfaces of the heat-exchange block (23*a, b, c, d, e*). The gas stream (23*a, b, c, d, e*) is fed to an taken off from these heat-exchange passages via in each case a collector/distributor (41) connected to the heat-exchange block (23*a, b, c, d, e*), which collector/distributor extends in each case over the entire end surface of the heat-exchange block (23*a, b, c, d, e*).

15 Claims, 7 Drawing Sheets

PROCESS AND APPARATUS FOR HEAT EXCHANGE

The invention relates to a process for the indirect heat exchange of a plurality of gas streams with a heat/cold carrier in heat-exchange blocks in which the gas streams are passed through a multiplicity of heat-exchange passages, with only one of the gas streams being passed through at least one heat-exchange block. In addition, the invention relates to a heat-exchange apparatus for the indirect heat exchange of at least two gas streams with a heat/cold carrier in heat-exchange blocks which have a multiplicity of heat-exchange passages.

In the low-temperature fractionation of air, the feed air to be fractionated must be cooled to the process temperature. This is customarily performed in the main heat exchanger by indirect heat exchange of the feed air with the gas streams produced. The main heat exchanger is generally constructed as a plate heat exchanger which has a multiplicity of heat-exchange passages for the streams to be treated. In air-fractionation plants where large amounts of air are processed, a plurality of such heat-exchange blocks are necessary to process the amounts of air and product. Customarily, in the main heat exchanger, from about 20,000 to 30,000 $m^3$(S.T.P.)/h of air are divided into two blocks.

Customarily, to date, all of the gas streams and the feed stream and if appropriate other streams are passed through each of the individual heat-exchange blocks. If, for example, two air streams of different pressures are fed to an air-fractionation plant and the gaseous products produced are oxygen, pure nitrogen and impure nitrogen, five streams must be passed through each heat-exchange block. Each heat-exchange block must therefore have ten connection ports for these streams, five each for the gas inlet and five for the gas outlet.

Correspondingly, ten apparatuses, termed collector/distributor below, are required in order to distribute the gas streams from the respective inlet port to the assigned heat-exchange passages and, respectively, to combine the gas streams exciting from the heat-exchange passages into the appropriate outlet ports.

The collectors/distributors have been implemented to date by distribution zones integrated into the heat-exchange block. In this distribution zones, at least some of the lamellae (i.e. closely spaced thin plate) fins which separate the individual heat-exchange passages from one another are arranged at an incline, so that the gas flowing in via the inlet port is conducted into the heat-exchange passages or such that the gas stream exiting from the heat-exchange passages is deflected to the outlet port.

The flow conditions are, however, greatly altered in the distribution zones of such collectors/distributors. Firstly, owing to the inclined orientation of the lamellae, a change in flow direction occurs, secondly, the cross-sections of the heat-exchange passages are markedly decreased in the distribution region, as a result of which the velocity of the gas flowing through can he changed. Both effects produce an unwanted pressure drop in the heat-exchange blocks.

DE-A-42 04 172 discloses dividing the main heat exchanger of an air-fractionation plant into a plurality of blocks on the process side, with each product stream produced in the air-fractionation plant being fed via a separate heat-exchange block against feed air. The purpose of the process is to decrease the control requirement for the individual heat-exchange blocks. DE-A-42 04 172, on the other hand, is not concerned with the pressure drop caused by the distribution zones of the blocks and therefore also does not contain any measures which would be suitable for decreasing this pressure drop. The object of the present invention is to develop a process and an apparatus for the indirect heating or cooling of a plurality of gas streams in which the pressure drop in the heat exchanger is as small as possible.

This object is achieved according to the invention by a process of the type mentioned at the outset, in which the heat-exchange passages for the one gas stream of the at least one heat-exchange block end at two end surfaces of the heat-exchange block and the one gas stream is fed to and taken off from the heat-exchange passages of the at least one heat-exchange block via in each case a collector/distributor connected to the heat-exchange block, which collector/distributor extends in each case over the entire end surface of the heat-exchange block.

The inventive heat-exchange apparatus for the indirect heat exchange of at least two gas streams with a heat/cold carrier in heat-exchange blocks which have a multiplicity of heat-exchange passages is distinguished by the face that the heat-exchange passages of a heat-exchange block which are provided for one of the gas streams end at two opposite end surfaces of the heat-exchange block and are each flow-connected to a collector/distributor, the collectors/distributors extending in each case over the entire end surface of the heat-exchange block.

According to the invention at least one gas stream which is to experience as small as possible a pressure drop is passed through a heat-exchange block through which otherwise no other gas streams are conducted. Obviously, through this heat-exchange block, flow one or more heat or cold carriers with which the gas stream exchanges its heat. The heat-exchange passages of this heat-exchange block provided for this gas stream extend from an end side of the block to the opposite end side and run essentially in parallel. At the two end sides at which the heat-exchange passages end in each case a collector/distributor is mounted externally on the heat-exchange block, which collector/distributor covers the entire end surface and has a connection port for the feed line or outlet line. The heat-exchange passages thus pass without cross-sectional tapering into the feed line or outlet line and the flow deflection in the collector/distributor takes place slowly. The pressure drop in the heat-exchange block in the associated collectors/distributors is thus minimized.

By means of the inventive process and the corresponding apparatus, pressure drops in the heat-exchange blocks, measured from the inlet port to the outlet port, of about 70 mbar may be achieved. In comparison, in the conventional heat exchangers in which the distribution and combination of the gas streams between the inlet port and outlet port and the heat-exchange passages take place via a distribution zone which is integrated into the heat-exchange block and has inclined lamellae, a pressure drop of about 100 mbar occurs, if the gas streams are taken off from the low-pressure column at a pressure between 1.2 and 1.8 bar. On the unpressurized side, the invention achieves a reduction in pressure drop of about 30 mbar. This means that the low-pressure streams can be produced at a pressure which is lower by 30 mbar than otherwise. To maintain the heat-exchange conditions in the main condenser it is then sufficient if the air is compressed downstream of the air compressor to a pressure about 90 mbar lower.

Preferably, a separate heat-exchange block is provided for each gas stream. Firstly, this has the above-described advantage of the low pressure drop, secondly the amount of tubing required is decreased. In addition, there is also the reduction in costs of the heat-exchange blocks, since the distribution zones are made considerably simpler. In the customary process in which all gas streams flow through each heat-exchange block, each gas stream requires both on the cold side and on the warm side of the main heat exchanger in each case a manifold line as feed line or outlet line having a plurality of branches to each heat-exchange block. If, in contrast, each gas stream is conducted through a separate heat-exchange block, the branches can be dispensed with and the tubing is considerably simplified.

If the gas rate which is to be conducted via a separate heat-exchange block is so high that it cannot be processed in this block, two or more heat-exchange blocks are provided through which in each case substreams of this gas are passed.

The invention is particularly suitable in processes in which gas streams which have a pressure of less than 3.5 bar, preferably between 1.1 and 1.8 bar, termed hereinafter low-pressure streams, are to be brought into indirect heat exchange with a heat or cold carrier. According to the invention, in this case, only one of these low-pressure gas streams is conducted through a heat-exchange block, that is to say for each of the gas streams which have a pressure of less than 3.5 bar, a separate heat-exchange block is used.

In the case of gas streams having a pressure greater than approximately 4 bar, the pressure drop in the heat-exchange block plays only a minor role, or can be ignored. Therefore, it is sometimes advantageous to conduct, in addition, such a stream at elevated pressure through at least one of the heat-exchange blocks through which one of the low-pressure gas streams is passed.

The inventive process is used preferably in the low-temperature fractionation of feed air. The gas streams taken off as product from the low-pressure column of a double-column rectifier have only a slight superatmospheric of about 0.1 to 0.8 bar above atmospheric pressure, so that a reduction in pressure drop is of great importance. This applies similarly to gaseous argon product, since the crude argon column is also operated at a relatively low pressure.

Particularly preferably, the gas streams are brought into indirect heat exchange with the feed air. The feed air can be conducted in this case through the heat-exchange blocks in a plurality of streams at different pressure levels. Thus the feed air, on the one hand, can be passed at high pressure-column pressure through the heat-exchange block, for example, and then be fed into the high pressure column, on the other hand the feed air can be recompressed upstream of the heat-exchange block and, after cooling, be work-expanded to produce refrigeration.

In countries having relatively low energy costs decreasing the pressure drops may be of little advantage, since the costs associated with energy saving are high. In these applications it is therefore more expedient not to minimize the pressure drops, but to increase the flow rates, in order to achieve higher pressure drops as a result of which, finally, smaller heat-exchange blocks are required.

Preferably, the gas stream is passed through the heat-exchange block in a manner such that it experiences a pressure drop of 120 to 300 mbar, preferably 120 to 200 mbar. Increasing the pressure drop achieves a greater flow velocity than in the customary heat exchangers, which improves the heat transmission coefficients, which ultimately leads to the fact that the block volume of the heat exchanger can be reduced. For the same pressure drop in the heat-exchange block, the inventive process makes it possible to reduce block volumes by about 15%, compared with the known processes, which results in considerable cost savings.

BRIEF DESCRIPTION OF DRAWINGS

The invention and further details of the invention are described in more detail below with reference to exemplary embodiments shown in the drawings. In the drawings;

FIG. 1 is a process flowsheet known from the prior art of a large air-fractionation plant for processing about 100,000 $m^3$ (S.T.P.)/h of air, in which it is necessary to implement the main heat exchanger by a plurality of separate heat-exchange blocks 3.

Figure 1:
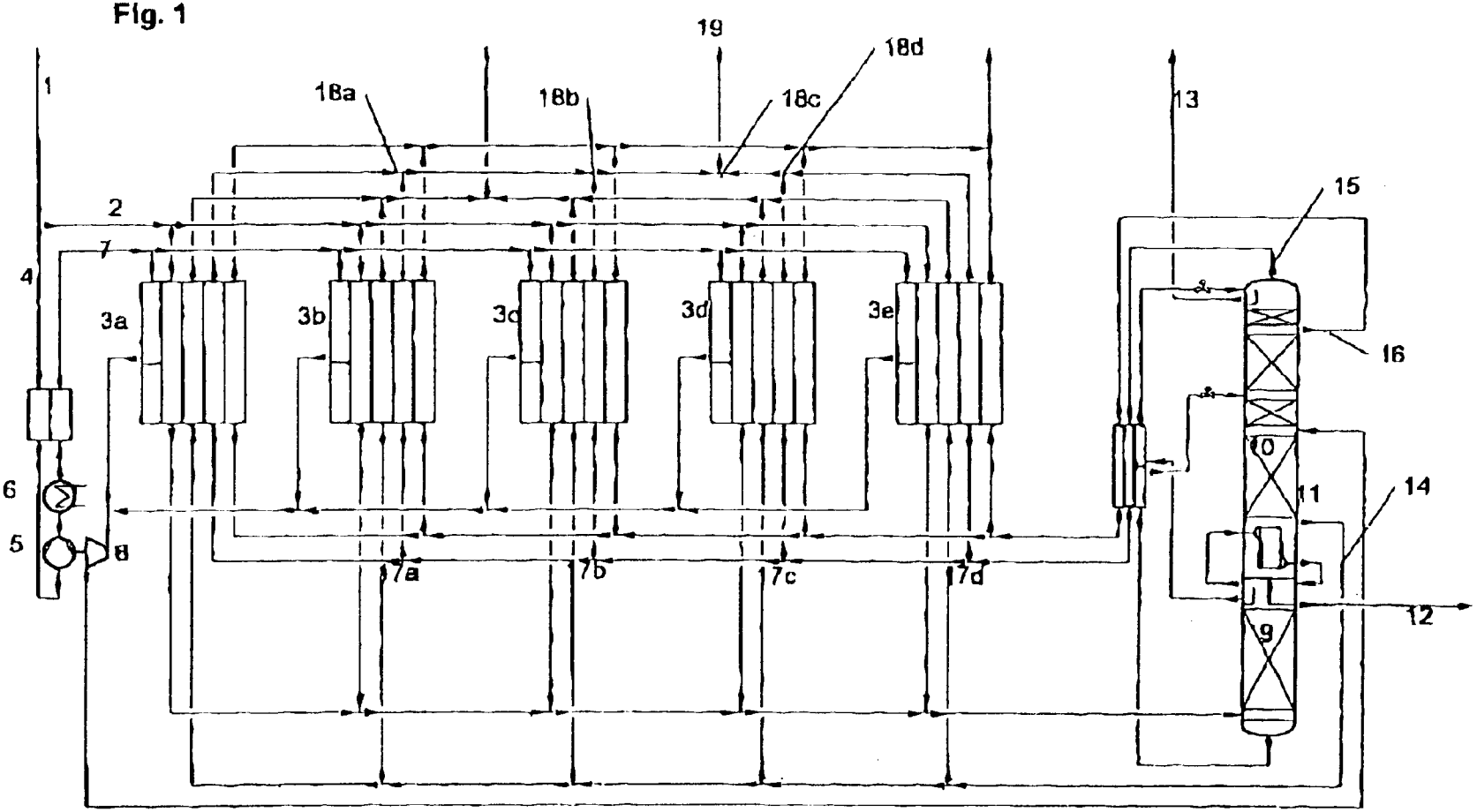
FIG. 1 shows the arrangement and construction of the main heat-exchange blocks of a large air fractionation plant having a plurality of main heat-exchange blocks according to the prior art.

Compressed and purified feed air 1 is fed in part 2 directly to a plurality of heat-exchange blocks 3*a*–3*e* arranged in parallel to one another, in part 4 recompressed by means of a compressor 5, cooled in an aftercooler 6 and then passed into the heat-exchange blocks 3*a*–3*e*. This pressurized air designated hereinafter as turbine air stream 7 is withdrawn from the heat-exchange blocks 3*a*–3*e* at an intermediate point, expanded in a turbine 8 and introduced into the low-pressure column 10 of a rectification unit 11 which comprises a high pressure column 9 and a low-pressure column 10.

The heat-exchange blocks 3*a*–3*e* form the main heat exchanger of the air-fractionation plant. The feed air 2 cooled in the blocks 3*a*–3*e* is fed to the high pressure column 9 of the rectification unit 11. Gaseous oxygen 14, gaseous nitrogen 15 and gaseous impure nitrogen 16 as regeneration gas are taken off from the low-pressure column 10 at a pressure of about 1.3 bar. In addition, it is possible to produce oxygen and nitrogen as liquid products 12, 13 in the rectification unit 11 The gas streams 14, 15, 16 are fed to each of the heat-exchange blocks 3*a*–3*e* and warmed by indirect heat exchange against the feed air stream 2 and the turbine air stream 7.

Since all gaseous streams 14, 15, 16 and, in countercurrent, the two air streams 2, 7, that is to say in total five different streams, are passed through each of the heat-exchange blocks 3*a*–3*e*, per heat-exchange block 3, ten collectors/distributors with the associated inlet and outlet ports are necessary, via which in each case the connection between the feed line tube and the outlet line tube and the corresponding heat-exchange passage is made.

Figure 2:
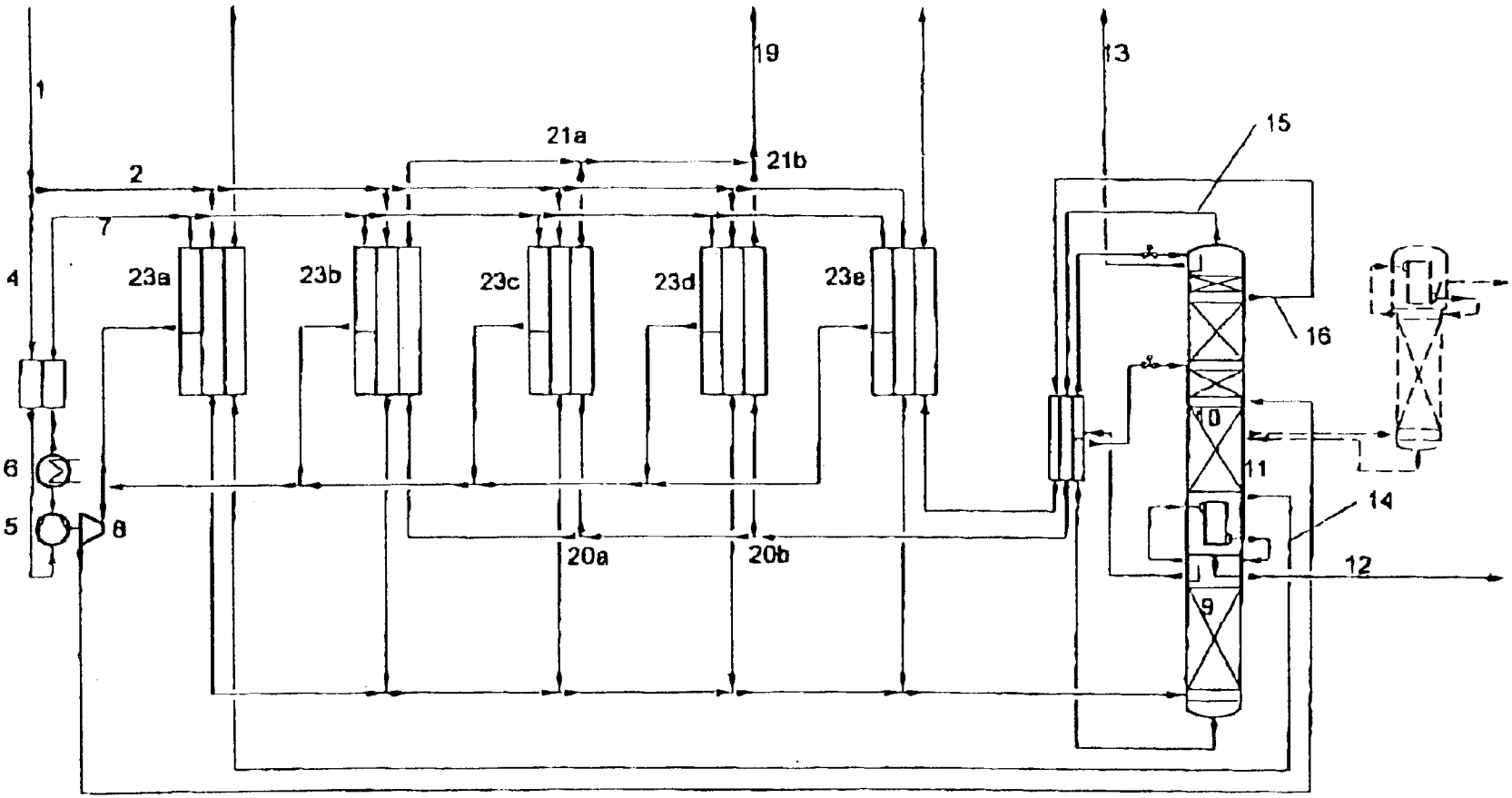
FIG. 2 shows the inventive configuration of the main heat-exchange blocks of a large air fractionation plant.

FIG. 2 shows a process diagram corresponding to FIG. 1, within which, in contrast to the known process shown in FIG. 1, the heat-exchange blocks 3 are divided according to the invention by product. The air stream 2 and the turbine air stream 7 are fed to all heat-exchange blocks 23*a*–23*e* just as in the process according to FIG. 1. In contrast, the gaseous gas streams 14, 15, 16 are no longer warmed in all heat-exchange blocks 23, but in blocks 23 specifically assigned in each case to the gas streams 14, 15, 16.

In each case about 20% of the air 1 fed in total is converted into gaseous oxygen 14 and impure nitrogen 16 in the rectification unit 11 by low-temperature fractionation of the air 1. The remaining 60% of the air 1 is taken off from the rectification unit 11 as gaseous pure nitrogen 15. The heat-exchange blocks 23 are dimensioned such that, for the gaseous oxygen stream 14 and the impure nitrogen stream 16, blocks 23*a*, 23*e*, respectively, having maximum dimensions result, that is to say the blocks 23*a* and 23*e* are designed exactly for the expected amounts of oxygen or nitrogen. For manufacturing reasons, all blocks 23*a*–23*e* are designed with identical size, so that three heat-exchange blocks 23*b*–23*d* are required for the pure nitrogen stream 15.

Thus, through the heat-exchange block 23*a* is conducted only oxygen 14 against the air streams 2 and 7, through the blocks 23*b* to 23*d* pure nitrogen 15 against air 2, 7 and through the heat-exchange block 23*e* impure nitrogen 16 against air 2, 7. The number of the heat-exchange blocks 23 thus remains the same as in the process of FIG. 1, since in both processes the same amounts of product must have their heat exchanged with the same amounts of air.

The block configuration is considerably simplified, however. Only three streams are fed to each heat-exchange block 23, two air streams 2, 7 and one gas stream 14, 15 or 16, as a result of which each block 23 only requires six collectors/distributors together with the corresponding connection ports.

Figure 6:
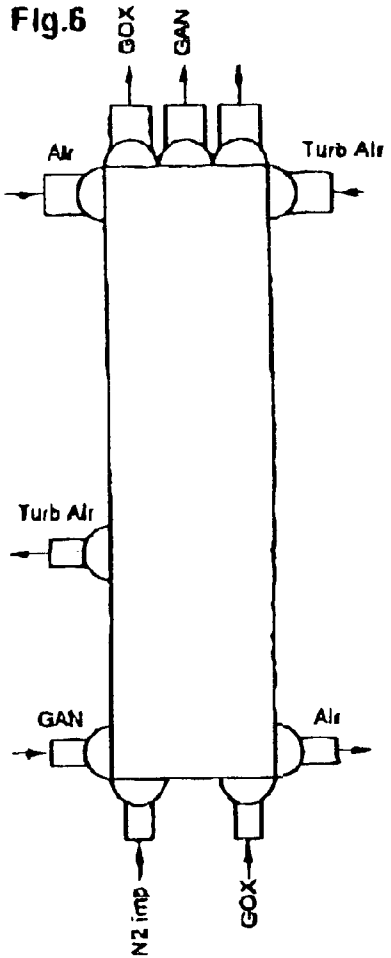
FIGS. 3 to 6 show the customary arrangement of the lamellae in the inlet and outlet region of the heat-exchange passages
Figure 5:
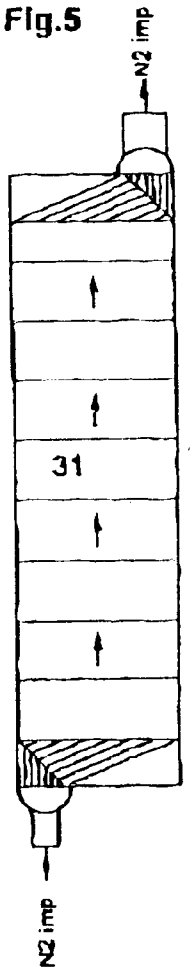
Figure 4:
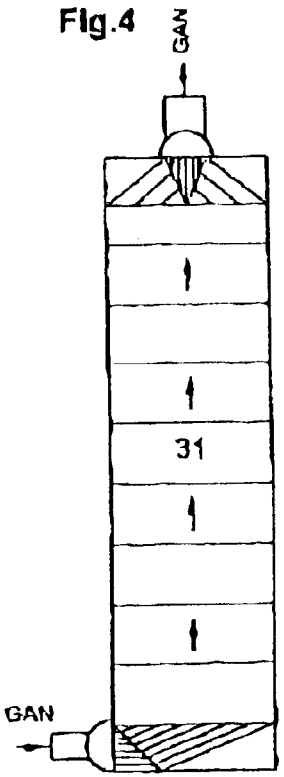
Figure 3:
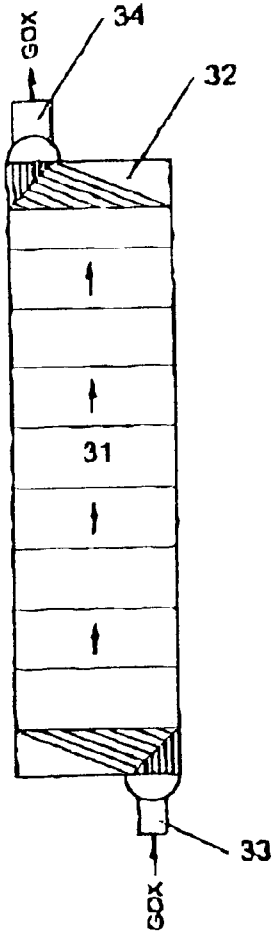
Figure 7:
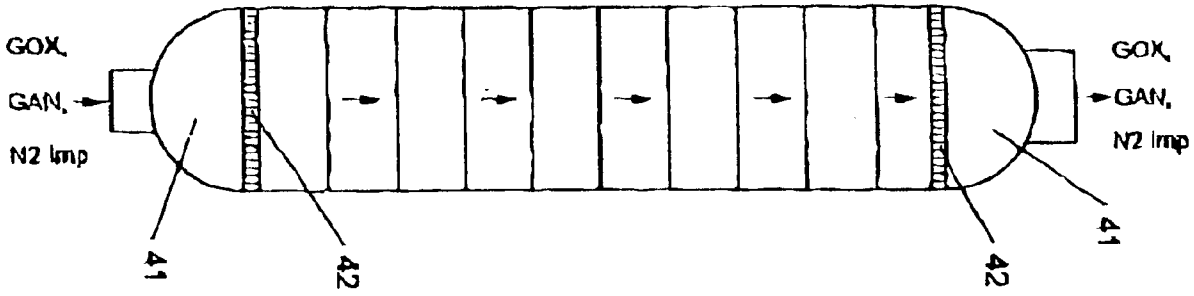
FIGS. 7 and 8 show the inventive collectors/distributors in the inlet and outlet regions of the heat-exchange passages.
Figure 8:
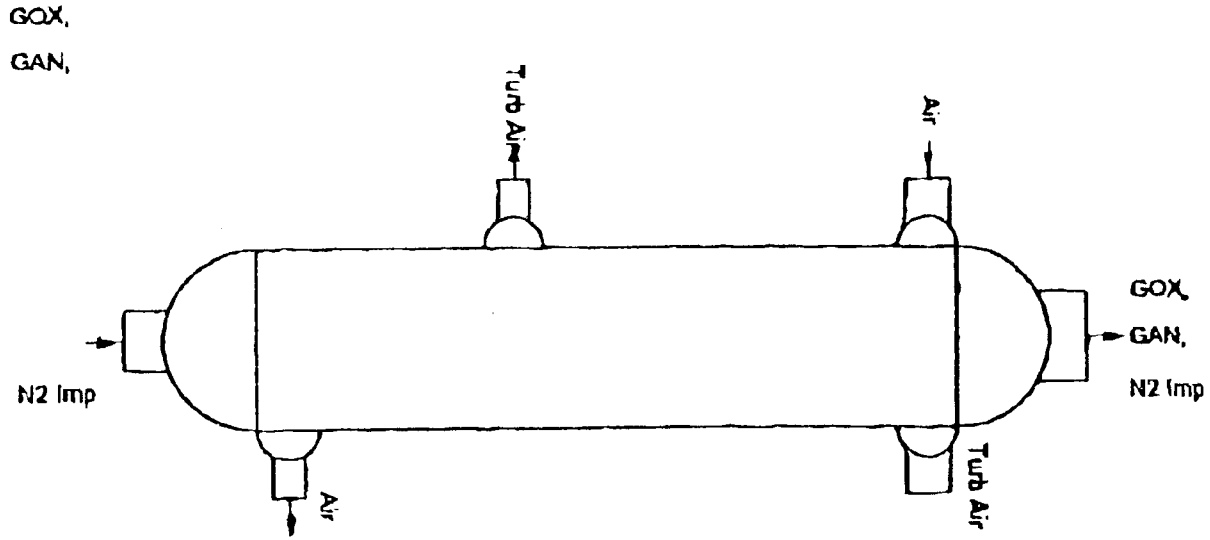

The heat-exchange blocks 23 are designed according to the invention in accordance with the FIGS. 7 and 8. For comparison, the structure of a heat-exchange block 3 of the type customary hitherto is shown in. FIGS. 3 to 6. FIG. 3 shows the lamellae arrangement 3 in the distribution zones 31 for the oxygen passages 34, FIG. 4 for the pure nitrogen passages 35 and FIG. 5, correspondingly, for the impure nitrogen passages 36. FIG. 6 shows the arrangement of all inlet and outlet ports, In the process according to FIG. 1, in the heat-exchange block 3, three different products 14, 15, 16 are conducted against the air stream 2 and the turbine air stream 7. The respective gaseous product is distributed to the corresponding heat-exchange passages 34, 35, 36 via distribution zones 31, 32, 33 which have inclined lamellae in order to distribute the gas 14, 15, 16 from the feed line 37*a*, 38*a*, 39*a* to the passages 31, 32, 33, and to unite the gas exiting from the passages 31, 32, 33 into the take-off line 37*b*, 38*b*, 39*b*.

The distribution zones 31, 32, 33 lead both to a change in the direction of flow and also to changes in cross section, which in turn cause changes in flow velocity. Both have an adverse effect on the flow through the block and produce an unwanted pressure drop over the heat-exchange block 3. The pressure drop has an adverse effect, in particular, in the case of the gas streams which have a relatively low pressure between 1.1 and 1.8 bar. Replacing the passages 34, 35, 36 for the gas streams 14, 15, 16 with those for the air 2 or the turbine air 7, which have laterally arranged inlet and outlet ports 40*a*, 40*b*, 41*a*, 41*b* (see FIG. 6), also introduces no improvement, since the air 2, 7 is distributed to the associated heat-exchange passages via similar distribution passages as those shown in FIGS. 3 to 5, and thus similar flow bends and cross-sectional changes occur.

Figure 9:
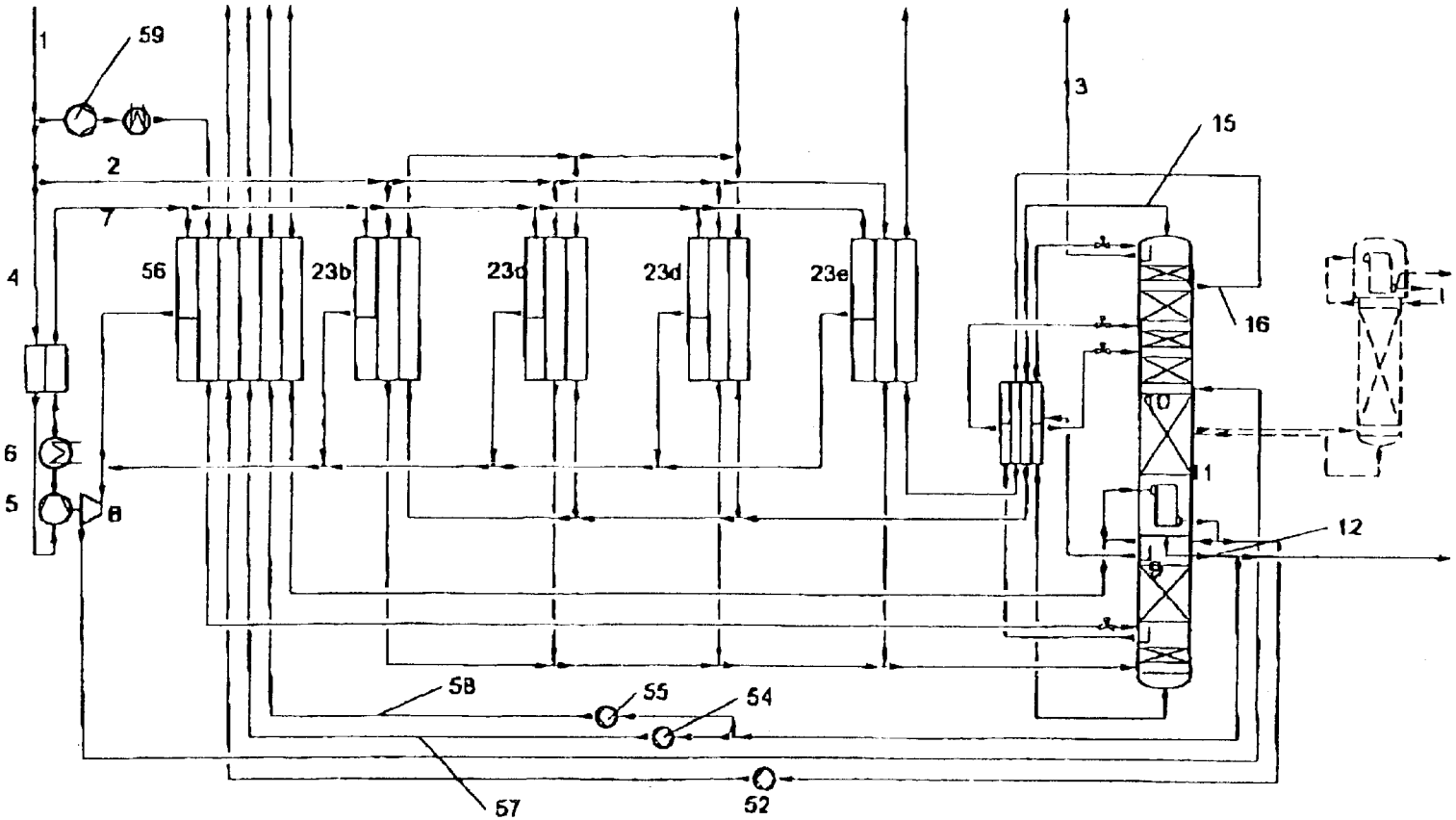
FIG. 9 shows an inventive process having oxygen and nitrogen internal compression.

FIGS. 7 and 9 show the novel block configuration. A chief feature of the inventive process is that in each heat-exchange block 23, only one of the gas streams 14, 15, 16 is conducted in countercurrent to air 2, 7.

Instead of the complex distribution zones 32 having inclined lamellae in the known heat-exchange blocks (see FIGS. 3 to 5), in the novel heat-exchange blocks, preferably only a narrow distribution zone 42 is provided at the inlet and outlet regions of the heat-exchange passages. The lamellae in the narrow distribution zone 42 are disposed in parallel to the heat-exchange passage lamellae below them or above them, but have a reduced distance from one another. The gas entering the collector 41 as a result readily backs up upstream of the distribution zone 42, which achieves a uniform distribution of the gas over all passages of the distribution zone 42 and thus over all heat-exchange passages.

With reference to FIGS. 1 and 2, a further advantage of the inventive process becomes clear. In addition to the markedly decreased pressure drop over the heat-exchange blocks 23, in the novel process the tubing becomes considerably simpler. In addition to reducing the number of block ports from ten to six per heat-exchange block, few collection lines and tube branches are also required to feed the gas streams 14, 15, 16 to blocks 23.

In FIG. 1 it may be seen that, for example, four tube branches 17*a*–17*d* depart from the nitrogen product line 15 in order to distribute the nitrogen to the five heat-exchange blocks 3. Conversely, four tube branches 18*a*–18*d* are necessary in order to unite the warmed nitrogen back into the collection line 19. For each of the five streams passed through the heat-exchange blocks, therefore eight tube branches must be provided, in total therefore 40 tube branches or tube junctions.

In contrast thereto, in the inventive process according to FIG. 2, only the air stream 2 and the turbine air stream 7 are distributed over all five heat-exchange blocks 23, for which, correspondingly, 16 tube branches are necessary. In addition, there are two branches 20*a*, b and two tube junctions 21*a*, b to distribute the nitrogen stream 15 over the blocks 23*b, c, e* and subsequently combine them into the take-off line 19.

In the inventive process, with respect to tubing requirement there is a total of 20 branches, compared with a requirement of 40 branches in the conventional process according to FIG. 1. This reduction by 50% is a significant verification for the simplification of the tubing complexity.

The inventive process is not restricted only to such processes in which all products can be produced in the gaseous state, but, for example, also to internal compression processes in which liquid products are taken off from the rectification unit.

FIG. 9 shows the diagram of an air-fractionation process in which, in addition to gaseous pure nitrogen 15 and gaseous impure nitrogen 16, liquid nitrogen 51 is taken off from the main condenser of the rectification unit 11 and brought to elevated pressure by means of an internal compression pump 52. The liquid nitrogen 51 which is brought to elevated pressure is then vaporized and warmed in the heat-exchange block 56 against air 7 and high-pressure air compressed by means of the compressor 59.

The oxygen 12 in this process is also withdrawn in liquid form from the low-pressure column 10 and internally compressed using the two pumps 54 and 55. The pure nitrogen stream 15 and the impure nitrogen stream 16 are warmed in the heat-exchange blocks 23*b, c, d* and the block 23*e*, each of which are constructed according to FIGS. 7 and 8. To vaporize and warm the internally compressed streams 57, 58, in contrast, a high-pressure heat-exchange block 56 is used. The high-pressure heat-exchange block 56 corresponds on first inspection to the heat-exchange block described with reference to FIGS. 3 to 6, but has a significantly higher strength in order to be able to withstand the high pressures of the internal compression streams. The pressure drops occurring in the heat-exchange block 56 have a substantially less adverse effect on the internal compression streams 57, 58 than in the case of the gaseous gas streams 15, 16 from the low-pressure column 10.

Figure 10:
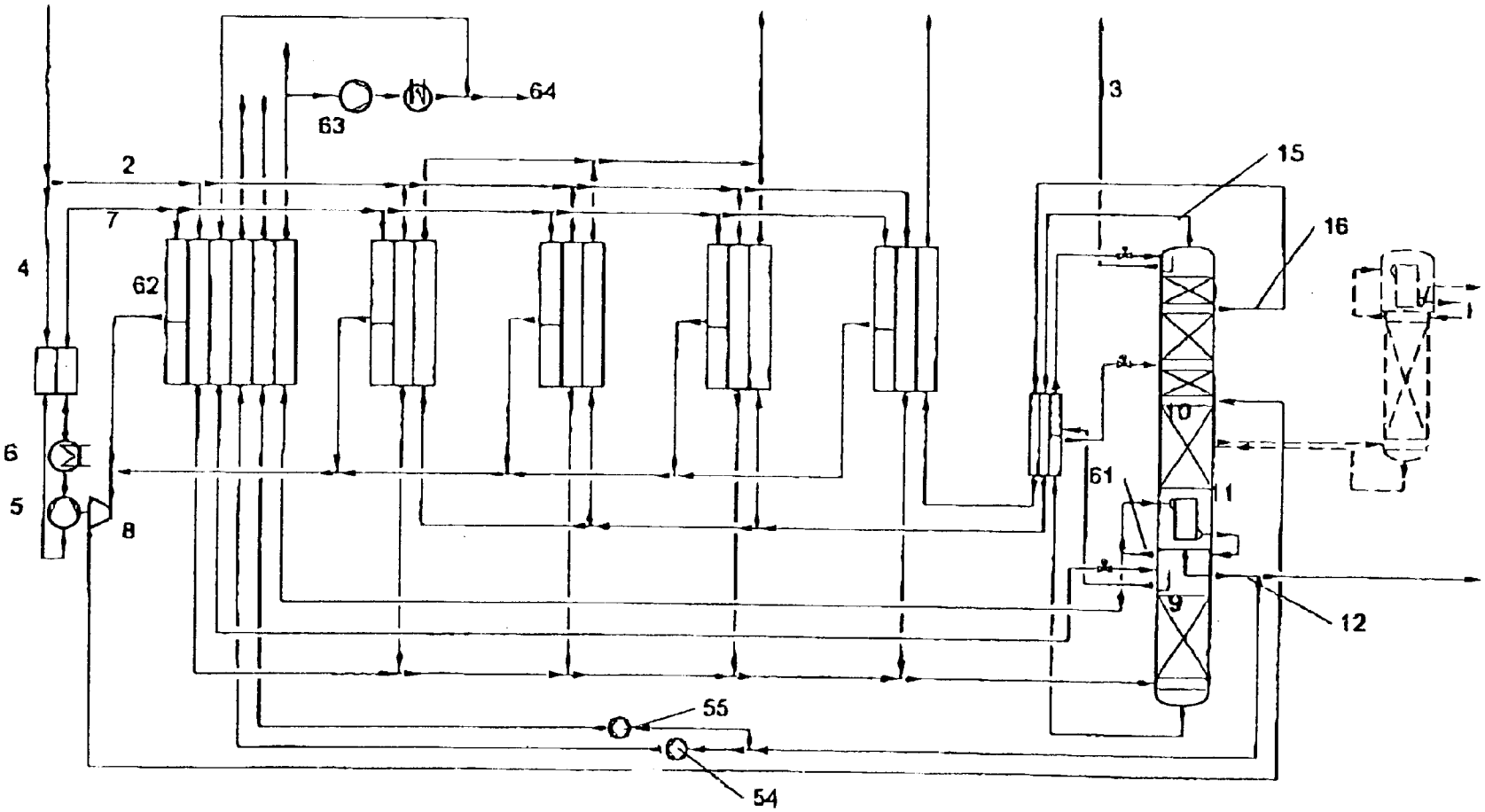
FIG. 10 shows an inventive process having oxygen internal compression and FIG. 11 shows an air-fractionation process with a nitrogen cycle.

A similar process to that in FIG. 9 is shown in FIG. 10, in which liquid oxygen 12 is also internally compressed 54, 55, but is vaporized and warmed, not against high-pressure air, but against high-pressure nitrogen. For this purpose gaseous nitrogen is taken off from the pressure column 9 at 61, conducted through the heat-exchange block 62, compressed by means of the compressor 63 and passed in countercurrent through the heat-exchange block 62 back to the pressure column 9. The heat-exchange block 62 essentially corresponds in its construction to the heat-exchange block 56 in FIG. 9. There is no internal compression of nitrogen in this variant, since high-pressure nitrogen 64 can be taken off downstream of the compressor 63.

Figure 11:
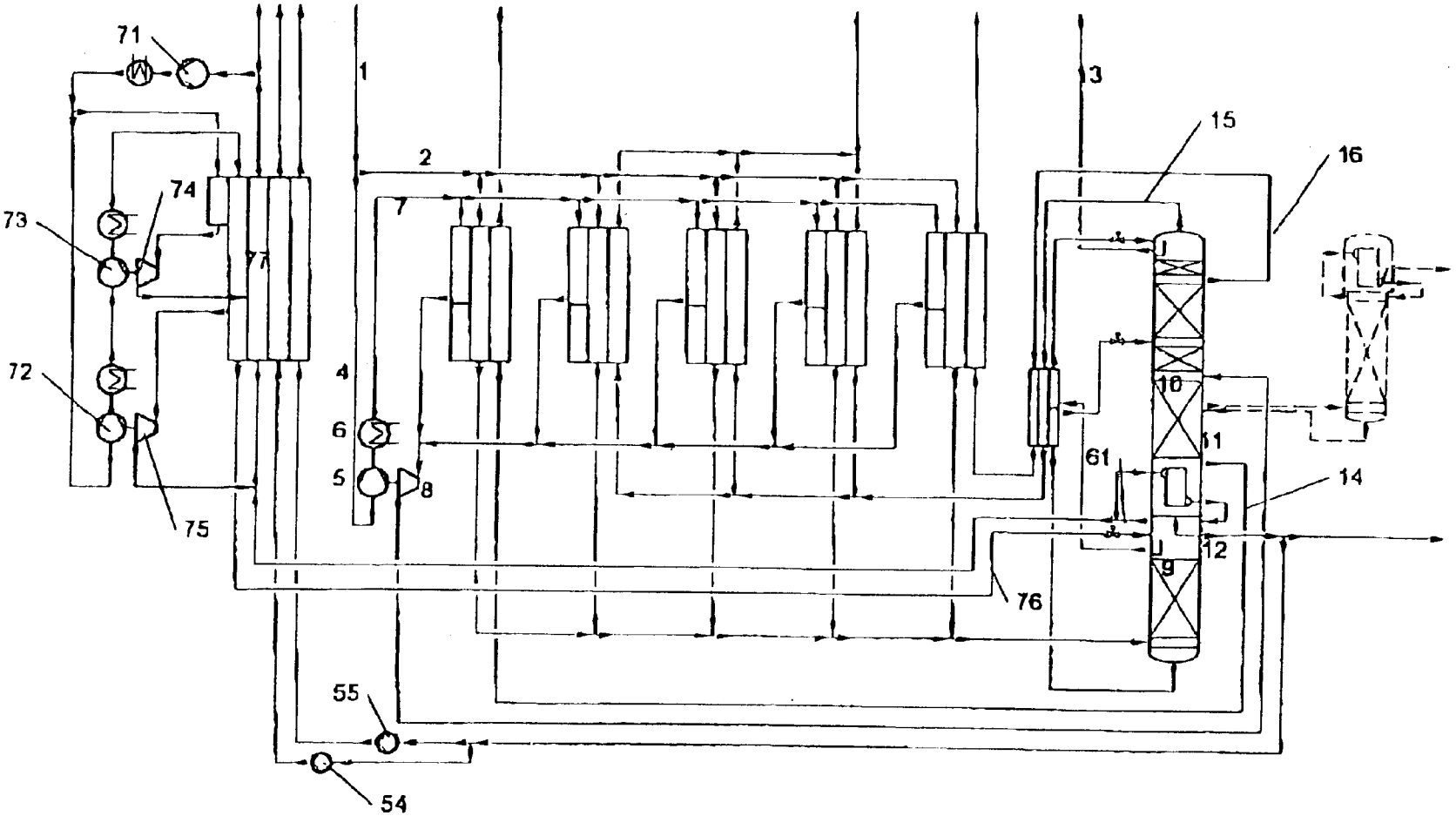

FIG. 11 shows a further application of the inventive process. In this case liquid oxygen is withdrawn from the rectification column 11 at 12 and internally compressed by the two pumps 54, 55. The liquid oxygen in this exemplary embodiment is vaporized against cycle nitrogen, which is taken off at 61 from the pressure column 9, warmed in the heat-exchange block 77, compressed by the compressors 71, 72, 73 and cooled in the heat-exchange block 77 against the internal compression products and passed 76 into the pressure column 9. A portion of the nitrogen is expanded (74) downstream of the compressor 71 and recirculated to the nitrogen cycle. A further portion of the nitrogen is taken off at an intermediate point from the heat-exchange block 77 downstream of compression in the compressors 71, 72, 73 and subsequent cooling in the heat-exchange block 77, expanded at 75 and returned to the nitrogen cycle.

Referring again to FIGS. 3–5, the heat exchanger blocks are theoretically not limited to plate heat exchangers; however, in practice only plate heat exchangers, and preferably aluminum plate heat exchangers, are used. Aluminum plate-fin heat exchangers are described in a brochure of Linde AG. Process Engineering and Contracting Division entitled a "Aluminum plate-fin heat exchangers". Descriptions of other plate heat exchangers are found in the literature, e.g. Chemical Engineers' Handbook, Perry & Chilton, 5th edition, McGraw-Hill, New York, 1973 pages 11–22 and 11–23.

It is also to be noted that a typical length of the distribution zone would be about 100 to 200 mm for a heat exchanger block having a total length of about 4,000 to 5,000 mm. The flow resistance in the distribution zone is about 5 to 10% higher than in the active heat exchanger section. This is achieved, for example by increasing the spacing of the fins or by using fins with an increased wall thickness.

The preceding specific embodiments are to be construed as merely illustrative, and not limitative of the remainder of the disclosure in any way whatsoever.

The entire disclosure of all applications, patents and publications, cited above and below, and of corresponding German application 10021081.3, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. Process for the indirect heat exchange of a plurality of gas streams with a heat/cold carrier in heat-exchange blocks in which the gas streams are passed through a multiplicity of heat-exchange passages, with only one of the gas streams being passed through at least one heat-exchange block, characterized in that the heat-exchange passages for the one gas stream (14, 15, 16) of the at least one heat-exchange block (23*a, b, c, d, e*) end at two end surfaces of the heat-exchange block (23*a, b, c, d, e*) and the one gas stream (14, 15, 16) is fed to and taken off from the heat-exchange passages of the at least one heat-exchange block (23*a, b, c, d, e*) via in each case a collector/distributor (41) connected to the heat-exchange block (23*a, d, c, d, e*), which collector/distributor extends in each case over the entire end surf ace of the heat-exchange block (23*a, b, c, d, e*).

2. Process according to claim 1, characterized in that each of the gas streams (14, 15, 16) is passed through a separate heat-exchange block (23*a, b, c, d, e*).

3. A process according to claim 1, wherein the one gas stream (14, 15, 16) at a pressure of less than 3.5 bar, is passed through the heat-exchange block (23*a, b, c, d, e*).

4. A process according to claim 1, wherein the gas streams (14, 15, 16) in each case have a pressure of less than 3.5 bar.

5. A process according to claim 4, further comprising passing an additional stream at a pressure of more than 4 bar through the at least one heat-exchange block.

6. A process according to claim 4, wherein said pressure of less than 3.5 bar is 1.1 to 1.8 bar.

7. A process according to claim 1, wherein the gas streams are produced by low-temperature fractionation of feed air (1).

8. A process according to claim 7, wherein the gas streams (14, 15, 16) are brought into indirect heat exchange with the feed air (2, 7).

9. A process according to claim 8, wherein the feed air is processed at a rate of more than 50 000 $m^3$ (S.T.P.)/h.

10. A process according to claim 9, wherein the rate of feed air is more than 100,000 $m^3$ (S.T.P.)/h.

11. A process according to claim 9, wherein said pressure of less than 3.5 bar is 1.1 to 1.8 bar.

12. A process according to claim 1, wherein the one gas stream is passed through the heat-exchange block (23*a, b, c, d, e*) with a pressure drop in the heat-exchange block (23*a, b, c, d, e*) of less than 100 mbar.

13. A process according to claim 12, wherein the pressure drop is less than 80 mbar.

14. A process according to claim 1, wherein the one gas stream (14, 15, 16) is passed through the heat-exchange block (23*a, b, c, d, e*) with a pressure drop in the heat-exchange block of between 80 and 300 mbar.

15. A process according to claim 14, wherein the pressure drop is between 100 and 250 mbar.

* * * * *